US007719391B2

(12) United States Patent
Zhang et al.

(10) Patent No.: US 7,719,391 B2
(45) Date of Patent: May 18, 2010

(54) DIELECTRIC RESONATOR CIRCUITS

(75) Inventors: Zhengxue Zhang, Nashau, NH (US); Kristi Dhimiter Pance, Auburndale, MA (US)

(73) Assignee: Cobham Defense Electronic Systems Corporation

( * ) Notice: Subject to any disclaimer, the term of this patent is extended or adjusted under 35 U.S.C. 154(b) by 329 days.

(21) Appl. No.: 11/425,580

(22) Filed: Jun. 21, 2006

(65) Prior Publication Data

US 2007/0296529 A1 Dec. 27, 2007

(51) Int. Cl.
*H01P 1/20* (2006.01)

(52) U.S. Cl. ..... 333/202; 333/219.1

(58) Field of Classification Search ..... 333/202, 333/203, 206, 208, 212, 230
See application file for complete search history.

(56) References Cited

U.S. PATENT DOCUMENTS

| | | | | | |
|---|---|---|---|---|---|
| 2,432,093 | A | * | 12/1947 | Fox | 333/209 |
| 3,475,642 | A | | 10/1969 | Karp et al. | 315/3.5 |
| 4,138,652 | A | | 2/1979 | Nishikawa et al. | 333/82 R |
| 4,267,537 | A | | 5/1981 | Karmel | 333/231 |
| 4,283,649 | A | | 8/1981 | Heinouchi | 310/324 |
| 4,423,397 | A | * | 12/1983 | Nishikawa et al. | 333/219.1 |
| 4,459,570 | A | | 7/1984 | Delaballe et al. | 333/202 |
| 4,477,785 | A | | 10/1984 | Atia | 333/202 |
| 4,578,655 | A | | 3/1986 | Etienne et al. | 333/202 |
| 4,620,168 | A | | 10/1986 | Delestre et al. | 333/202 |
| 4,757,289 | A | | 7/1988 | Kosugi et al. | 333/209 |
| 4,810,984 | A | | 3/1989 | Arnold et al. | 333/202 |
| 4,821,006 | A | | 4/1989 | Ishikawa et al. | 333/202 |
| 4,835,498 | A | | 5/1989 | Rouger et al. | 333/205 |
| 4,881,051 | A | | 11/1989 | Tang et al. | 333/208 |
| 5,059,929 | A | | 10/1991 | Tanaka | 333/219.1 |
| 5,109,207 | A | | 4/1992 | Aizawa et al. | 333/222 |

(Continued)

FOREIGN PATENT DOCUMENTS

EP 0 492 304 A1 7/1992

(Continued)

OTHER PUBLICATIONS

Partial International Search Report, International Application No. PCT/US2007/014253.

(Continued)

*Primary Examiner*—Benny Lee
(74) *Attorney, Agent, or Firm*—Jaeckle, Fleischmann & Mugel, LLP

(57) ABSTRACT

The invention is a dielectric resonator circuit comprising a housing; first, second, and third resonators positioned substantially in a row within the housing with said second resonator positioned between the first and third resonators, wherein the resonators are positioned relative to each other such that a field generated in each resonator couples to an adjacent resonator; wherein the housing encloses the resonators and has a separating wall positioned between the first and third resonators in order to control electromagnetic coupling between the first and third resonators; and wherein said first separating wall comprises a first end and a second end along a length thereof and wherein the separating wall defines an iris at the first end, the wall comprising a main wall portion positioned substantially between the first and third resonators and an extension wall portion at the first end that extends at an angle from the main wall portion of said wall.

32 Claims, 13 Drawing Sheets

U.S. PATENT DOCUMENTS

| | | | | |
|---|---|---|---|---|
| 5,140,285 | A | 8/1992 | Cohen | 331/96 |
| 5,218,330 | A | 6/1993 | Omiya et al. | 333/223 |
| 5,220,300 | A * | 6/1993 | Snyder | 333/210 |
| 5,351,319 | A | 9/1994 | Remillard et al. | 333/219 |
| 5,525,945 | A | 6/1996 | Chiappetta et al. | 333/202 |
| 5,614,875 | A | 3/1997 | Jang et al. | 333/202 |
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,805,033 | A * | 9/1998 | Liang et al. | 333/202 |
| 5,841,330 | A | 11/1998 | Wenzel et al. | 333/202 |
| 5,859,574 | A | 1/1999 | Schmitt | 333/202 |
| 5,949,309 | A | 9/1999 | Correa | 333/202 |
| 6,111,339 | A | 8/2000 | Ohya et al. | 310/358 |
| 6,208,227 | B1 | 3/2001 | Remillard et al. | 333/219 |
| 6,262,639 | B1 | 7/2001 | Shu et al. | 333/202 |
| 6,402,981 | B1 | 6/2002 | Sasaki | 252/62.9 PZ |
| 6,707,353 | B1 | 3/2004 | Yamakawa et al. | 333/202 |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |
| 2007/0115080 | A1 * | 5/2007 | Pance et al. | 333/202 |

FOREIGN PATENT DOCUMENTS

| | | | |
|---|---|---|---|
| EP | 1 181 740 | B1 | 3/2003 |
| EP | 1 772 925 | A1 | 4/2007 |
| GB | 1 376 938 | | 12/1974 |
| GB | 1 520 473 | | 8/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | | 6/1995 |
| JP | 07-154116 | A | 6/1995 |
| JP | 03-249803 | | 9/2003 |
| WO | WO 97/02617 | | 1/1997 |
| WO | WO 00/70706 | | 11/2000 |
| WO | WO 01/43221 | | 6/2001 |
| WO | WO 2004/027917 | A2 | 4/2004 |
| WO | WO 2004/027917 | A3 | 4/2004 |

OTHER PUBLICATIONS

Hui et al. "Dielectric Ring-Gap Resonator for Application in MMIC's" IEEE Transactions on Microwave Theory and Techniques vol. 39, No. 12, Nov. 1991.

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

J. S. Hersch et al., "Observation of Proximity Resonances in a Parallel-Plate Waveguide", Physical Review Letters, vol. 81, No. 15, Oct. 12, 1998, The American Physical Society, pp. 3059-3062.

M. A. Gerdine, "A Frequency-Stabilized Microwave Band-Rejection Filter Using Filter Using High Dielectric Constant Resonators", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{01\delta}$Dielectric Resonator Modes" Electronics Letters, May 25, 1989, vol. 25 No. 11, pp. 693-694.

T. Nishikawa et al., "Dielectric High-Power Bandpass Filter Using Quarter-Cut $TE_{01\delta}$ Image Resonator for Cellular Base Stations", IEEE Transactions on Microwave Theory and Techniques, Vol. MTT-35, No. 12, Dec. 1987.

A. A. Kishk et al., "Conical Dielectric Resonator Antennas for Wide-Band Applications", IEEE Transactions on Antennas and Propagation, vol. 50, No. 4, Apr. 2002 pp. 469-474.

* cited by examiner

DIELECTRIC RESONATOR CIRCUITS

BACKGROUND OF THE INVENTION

1. Field of the Invention

The invention pertains to dielectric resonator circuits. More particularly, the invention pertains to dielectric resonator circuits comprising housings adapted to prevent cross coupling between non-adjacent resonators.

2. Background

Dielectric resonators are used in many circuits, particularly microwave circuits, for concentrating electric fields. They can be used to form filters, oscillators, triplexers, and other circuits. The higher the dielectric constant of the material out of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a magnetic constant of 1, i.e., they are transparent to magnetic fields.

Generally, as the dielectric constant of the material of the resonators increases, higher center frequencies of the given circuit can be achieved.

FIG. 1 is a perspective view of a typical dielectric resonator of the prior art. As can be seen, the resonator 10 is formed as a cylinder 12 of dielectric material with a circular, longitudinal through hole 14. Individual resonators are commonly called "pucks" in the relevant trades. While dielectric resonators have many uses, their primary use is in connection with microwaves and, particularly, in microwave communication systems and networks.

As is well known in the art, dielectric resonators and resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is the transverse electric field mode, $TE_{01\delta}$ (or TE, hereafter). The second mode is commonly termed the hybrid mode, $H_{11\delta}$ (or $H_{11}$, hereafter). The $H_{11}$ mode is excited from the dielectric resonator, but a considerable amount of electric field lays outside the resonator and, therefore, is strongly affected by the cavity. The $H_{11}$ mode is the result of an interaction of the dielectric resonator and the cavity within which it is positioned. The $H_{11}$ mode field is orthogonal to the TE mode field. There also are additional higher modes.

Typically, it is the fundamental TE mode that is the desired mode of the circuit or system into which the resonator is incorporated. However, other modes, and particularly the $H_{11}$ mode, often are used in the proper circumstances, such as dual mode filters. Typically, all of the modes other than the mode of interest, e.g., the TE mode, are undesired and constitute interference.

FIG. 2 is a perspective view of a dielectric resonator filter 20 of the prior art employing a plurality of dielectric resonators 10*a*, 10*b*, 10*c*, 10*d*. The resonators 10*a*, 10*b*, 10*c*, 10*d* are arranged in the cavity 22 of a conductive enclosure 24. The conductive enclosure 24 typically is rectangular, as shown in FIG. 2. Microwave energy is introduced into the cavity via an input coupler 28 coupled to a cable, such as a coaxial cable. The energy may then be coupled to a first resonator (such as resonator 10*a*) using a coupling loop.

The high dielectric constant of the material out of which the resonators are formed concentrates the electrical fields within the resonators. However, most dielectric resonators have a magnetic constant of 1, i.e., they are transparent to the magnetic fields. Accordingly, the magnetic fields exist mostly outside of the resonator bodies. The electromagnetic coupling between the resonators that occurs in multi resonator circuits such as illustrated in FIG. 2 is magnetic field coupling. As is well known, the magnetic fields are orthogonal to their associated electrical fields.

Conductive separating walls 32 separate the resonators from each other and block (partially or wholly) magnetic field coupling between physically adjacent resonators 10*a*, 10*b*, 10*c*, 10*d*. Particularly, irises 30*a*, 30*b*, 30*c* in walls 32*a*, 32*b*, 32*c*, 32*d* control the coupling between adjacent resonators 10*a*, 10*b*, 10*c*, 10*d*. Conductive walls without irises generally prevent any coupling between the resonators separated by the walls, while walls with irises allow some coupling between these resonators. Specifically, conductive material within the electric field of a resonator essentially absorbs the ohmic component of the field coincident with the material and turns it into a current in the conductive material. In other words, conductive materials within the electric fields cause losses in the circuit.

Conductive adjusting screws (not shown) in conductive contact with the enclosure may be placed in the irises to further affect the coupling of the fields between adjacent resonators and provide adjustability of the coupling between the resonators, but are not used in the example of FIG. 2. When positioned within an iris, a conductive screw partially blocks the coupling between adjacent resonators permitted by the iris between them. Inserting more of the conductive screw into the iris reduces electric coupling between the resonators while withdrawing the conductive screw from the iris increases electric coupling between the resonators.

By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*.

Wall 32*a*, which does not have an iris or a cross-coupler, entirely prevents the field of resonator 10*a* from coupling with the physically adjacent resonator 10*d* on the other side of the wall 32*a*. Furthermore, resonator 10*a* does not appreciably couple with resonator 10*c* and resonator 10*b* does not appreciably couple with resonator l0*d* because of 1) the various blocking walls 32*a*, 32*b*, 32*c*, 32*d* and 2) the significant distance between the resonators that the field lines would have to traverse in order to get around those walls to couple with each other.

One or more metal plates 42 may be positioned adjacent each resonator to affect the field of the resonator to set the center frequency of the filter. Particularly, plate 42 may be mounted on a screw 44 passing through a top surface (not shown) of the enclosure 24. The screw 44 may be rotated to vary the spacing between the plate 42 and the resonator 10*a*, 10*b*, 10*c*, or 10*d* to adjust the center frequency of the resonator. A coupling loop connected to an output coupler 40 is positioned adjacent the last resonator 10*d* to couple the microwave energy out of the filter 20. Signals also may be coupled into and out of a dielectric resonator circuit by other methods, such as microstrips positioned on the bottom surface 44 of the enclosure 24 adjacent the resonators.

The sizes of the resonators 10*a*, 10*b*, 10*c*, 10*d*, their relative spacing, the number of resonators, the size of the cavity 22, the size of the irises 30*a*, 30*b*, 30*c*, and the size and position of the metal plates 42 all need to be precisely controlled to set the desired center frequency of the filter, the bandwidth of the filter, and the rejection in the stop band of the filter. More specifically, the bandwidth of the filter is controlled primarily by the amount of coupling of the electric and magnetic fields between the resonators. Generally, the closer the resonators are to each other, the more coupling between them and the wider the bandwidth of the filter. On the other hand, the center frequency of the filter is controlled in large part by the size of the resonator and the size and the spacing of the metal plates 42 from the corresponding resonators 10*a*, 10*b*, 10*c*, or 10*d*.

Thus, while the presence of separating walls such as walls 32*a*, 32*b*, 32*c*, 32*d* may be desirable in order to control the coupling between the adjacent resonators to the desired level, they generally lower the quality factor Q of the circuit. Q essentially is an efficiency rating of the system and, more particularly, is the ratio of stored energy to lost energy in the system. Parts of the fields generated by the resonators pass through all of the conductive components of the system, such as the enclosure, separating walls tuning plates, and adjusting screws and inherently generate currents in those conductive elements. Those currents essentially comprise energy that is lost to the system.

Occasionally, controlled cross coupling between non-adjacent resonators is desirable and can be provided by the incorporation of cross coupling mechanisms. For instance, U.S. Pat. No. 7,057,480 issued Jun. 6, 2006, which is incorporated fully herein by reference, discloses various mechanisms for cross-coupling a non-adjacent resonators in a resonator circuit.

However, in the majority of dielectric resonators filters and other circuits, cross coupling between non-electrically adjacent resonators is not desired.

Therefore, it is an object of the present invention to provide an improved dielectric resonator circuit.

It is a further object of the present invention to provide a dielectric resonator circuit having improved coupling isolation between non-adjacent resonators.

SUMMARY OF THE INVENTION

The invention is a dielectric resonator circuit comprising a housing and first, second, and third resonators positioned substantially in a row within the housing with the second resonator positioned between the first and third resonators, wherein the resonators are positioned relative to each other such that a field generated in each resonator couples to an adjacent resonator, wherein the housing encloses the resonators and has a separating wall positioned between the first and third resonators in order to control electromagnetic coupling between the first and third resonators; and wherein the first separating wall comprises a first end and a second end along a length thereof and wherein the separating wall defines an iris at the first end, the wall comprising a main wall portion positioned substantially between the first and third resonators and an extension wall portion at the first end that extends at an angle from the main wall portion of the wall.

DETAILED DESCRIPTION OF THE INVENTION

The invention is an improved dielectric resonator housing and dielectric resonator circuit in which the separating walls between non-adjacent resonators that define the irises for permitting adjacent resonators to electromagnetically couple are designed to include a first wall portion substantially parallel to the longitudinal axes of those non-adjacent resonators and an extension wall portion extending at an angle from the first wall portion. The extension wall portion preferably comprises two halves that are mirror images of each other about the plane defined by the first wall portion. Specific separating wall shapes include Y-shaped and T-shaped walls. In a preferred embodiment, each separating wall actually comprises two completely separate walls that define an open space there between, that open space having a length running along the longitudinal axis of a resonator that is intended to electromagnetically couple to the resonators on either side thereof. These separating walls permit essentially unfettered coupling between the adjacent resonator pairs, but substantially block electromagnetic coupling between the non-adjacent resonator pairs.

Figure 2:
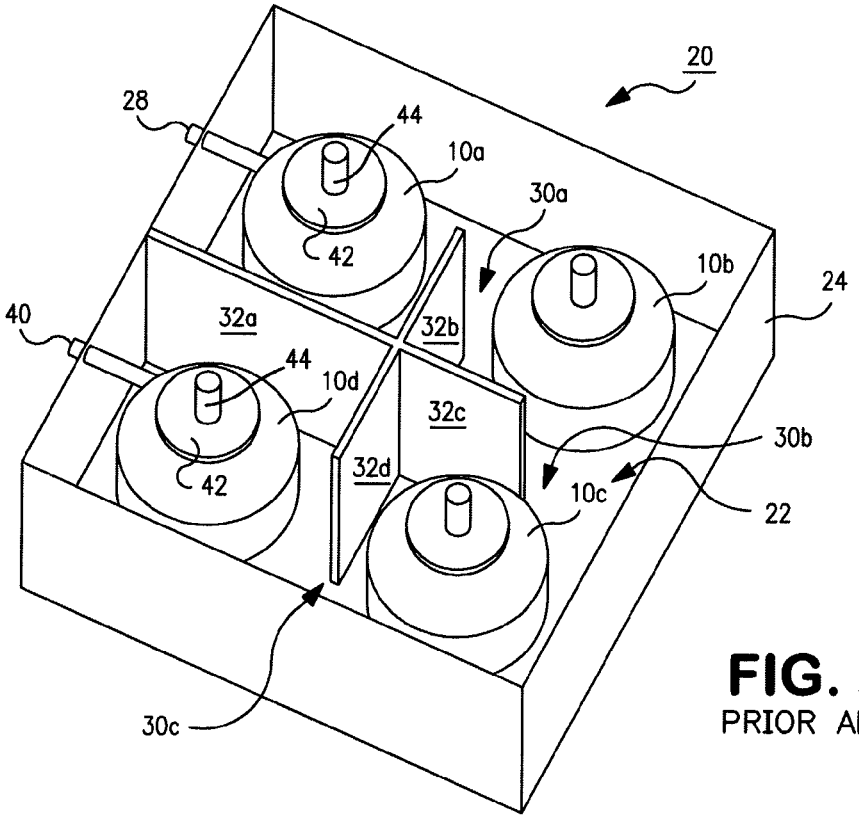
FIG. 2 PRIOR ART
FIG. 2 is a perspective view of an exemplary cross-coupled dielectric resonator filter of the prior art.

In the dielectric resonator circuit illustrated in FIG. 2 having a square housing with four resonator pucks and separating walls, the non-adjacent resonators are quite well isolated from each other in order to prevent cross coupling between non-adjacent resonators. However, in a resonator circuit in which three or more resonators are arranged in a row, it is more difficult to provide isolation between the non-adjacent resonators in the line. Particularly, when three or more resonators are in a row, there is a relatively direct path for electromagnetic coupling between the two non-adjacent resonators through the two irises or other openings that permit the adjacent resonators to couple with each other.

U.S. Pat. No. 7,310,037, issued Dec. 18, 2007, entitled Dielectric Resonators And Circuits Made Therefrom which is fully incorporated herein by reference, discloses new dielectric resonators as well as circuits using such resonators. One of the key features of the new resonators disclosed in the aforementioned patent application is that the field strength of the TE mode field outside of and adjacent the resonator varies along the longitudinal dimension of the resonator. As disclosed in the aforementioned patent application, a key feature of these new resonators that helps achieve this goal is that the cross-sectional area of the resonator measured parallel to the electric field lines of the TE mode varies along the longitude of the resonator, i.e., perpendicularly to the TE mode electric field lines. In one embodiment, the cross-section varies monotonically as a function of the longitudinal dimension of the resonator, i.e., the cross-section of the resonator changes in only one direction (or remains the same) as a function of height. In one preferred embodiment, the resonator is conical, as discussed in more detail below. Preferably, the cone is a truncated cone.

Figure 3:
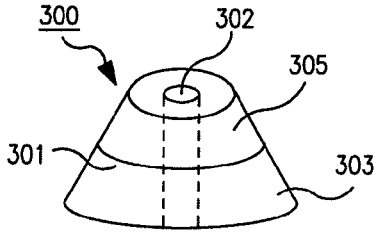
FIG. 3 is a perspective view of a conical dielectric resonator.

FIG. 3 is a perspective view of an exemplary embodiment of a dielectric resonator disclosed in the aforementioned patent application. As shown, the resonator 300 is formed in the shape of a truncated cone 301 with a central, longitudinal through hole 302. This design has many advantages over conventional, cylindrical dielectric resonators, including physical separation of the $H_{11}$ mode from the TE mode and/or almost complete elimination of the $H_{11}$ mode. Specifically, the TE mode electric field tends to concentrate in the base 303 of the resonator while the $H_{11}$ mode electric field tends to concentrate at the top 305 (narrow portion) of the resonator. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and therefore strongly couple, whereas their respective $H_{11}$ mode electric fields remain further apart from each other and, therefore, do not couple to each other nearly as strongly, if at all. Accordingly, the $H_{11}$ mode would not couple to the adjacent microwave device nearly as much as in cylindrical resonators, where the TE mode and the $H_{11}$ mode are physically located much closer to each other.

In addition, the mode separation (i.e., frequency spacing between the modes) is increased in a conical resonator. Even further, the top of the resonator may be truncated or the through hole may be counterbored with a larger diameter near the top to eliminate much of the portion of the resonator in which the $H_{11}$ mode field would be concentrated, thereby substantially attenuating the strength of the H11 mode.

Figure 1:
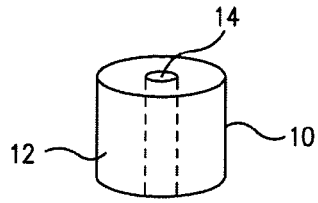
FIG. 1 PRIOR ART
FIG. 1 is a perspective view of a cylindrical dielectric resonator of the prior art.

Some of the concepts of the present invention are particularly useful when used in connection with conical resonators such as disclosed in U.S. Pat. No. 7,310,031, but also are applicable to more conventional cylindrical resonators, such as illustrated in FIG. 1.

Figure 4A:
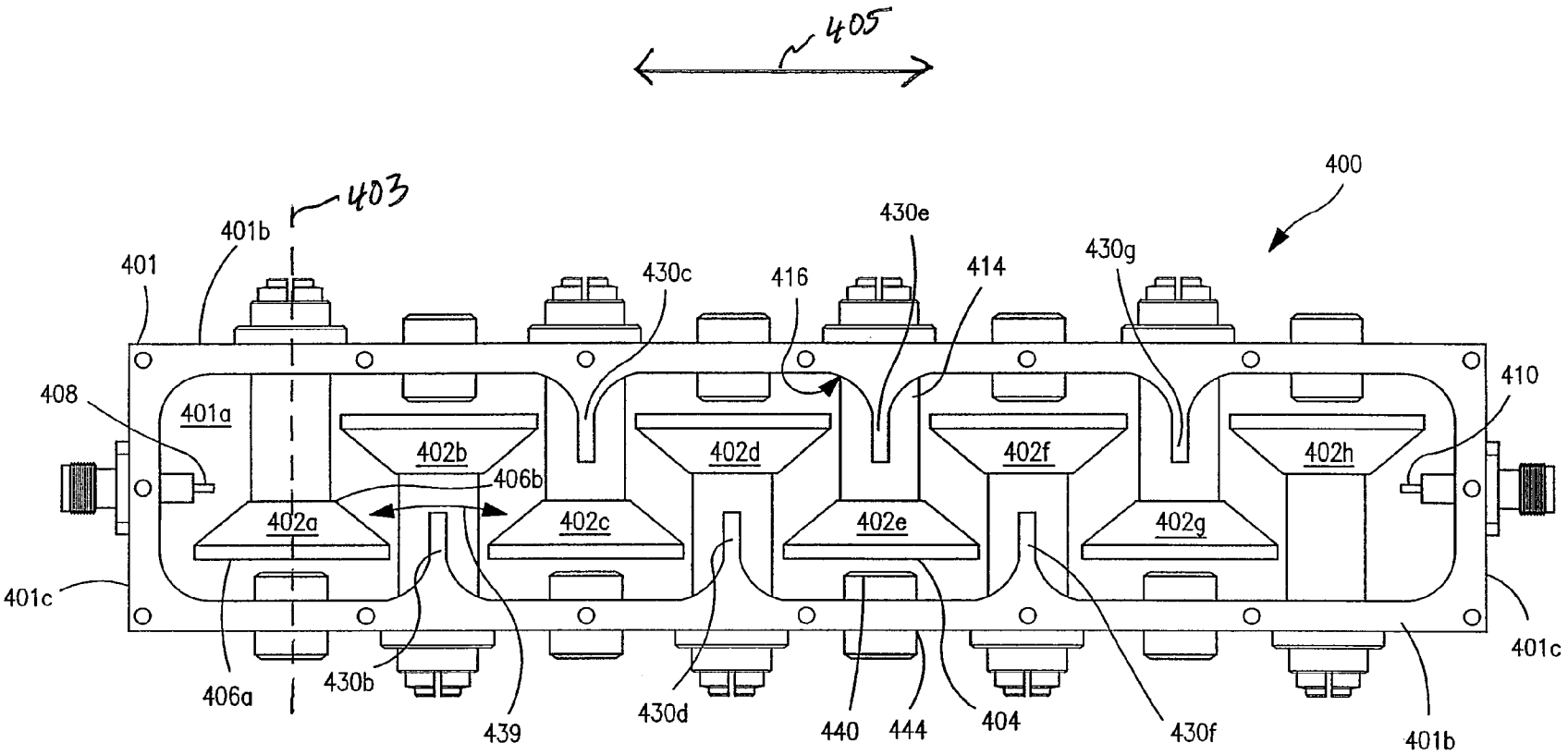
FIG. 4A is a top view of a dielectric resonator filter comprising a plurality of resonators arranged in a single row.
Figure 4B:
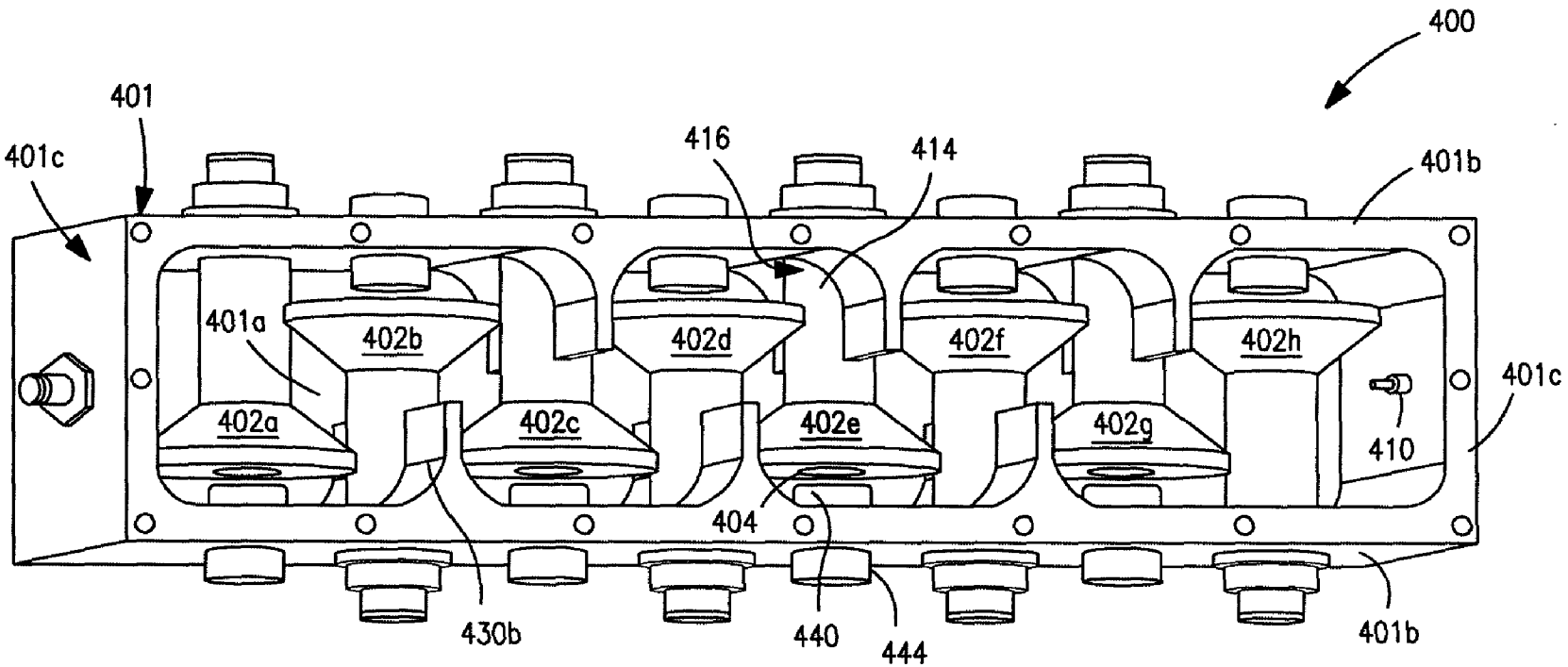
FIG. 4B is a perspective view of the filter of FIG. 4A.

FIGS. 4A and 4B depict a top view and a perspective view, respectively, of a dielectric resonator filter 400 in which a plurality of conical resonators 402*a*, 402*b*, 402*c*, 402*d*, 402*e*, 402*f*, 402*g*, 402*h* are disposed in a single row running in a first direction as illustrated by arrow 405. The filter 400 comprises an enclosure or housing 401 having a bottom 401*a*, side walls 401*b*, end walls 401*c* and a top wall (not shown in order to permit viewing of the components inside of the housing) to form a complete enclosure. Resonators 402*a*, 402*b*, 402*c*, 402*d*, 402*e*, 402*f*, 402*g*, 402*h* are positioned within the enclosure 401 for processing a field received within the cavity of the filter 400.

A field may be coupled into the filter 400 through any reasonable means, including by forming microstrips on a surface of the enclosure or by use of coupling loops as described in the background section of this specification. In one embodiment, a field supplied from a coaxial cable is coupled to an input coupling loop 408 (FIG. 4A) positioned near the first resonator 402*a* and passed at an output coupling loop 410 positioned near the last resonator 402*h*.

The plurality of resonators 402*a*, 402*b*, 402*c*, 402*d*, 402*e*, 402*f*, 402*g*, 402*h* are arranged within the enclosure in any configuration suitable to achieve the performance goals of the filter. In the illustrated embodiment, the resonators 402*a*, 402*b*, 402*c*, 402*d*, 402*e*, 402*f*, 402*g*, 402*h* are positioned in a row as previously mentioned. Specifically, the resonators 402*a*, 402*b*, 402*c*, 402*d*, 402*e*, 402*f*, 402*g*, 402*h* are positioned with their longitudinal axes 403 (FIG. 4A) parallel and coplanar with each other (that plane being the plane of the page in FIG. 4A). However, their longitudinal axes are not collinear, i.e., they are not stacked longitudinally, but, rather, are positioned generally laterally (side-by-side) with each other. As will be described in detail below, the resonators 402*a*, 402*b*, 402*c*, 402*d*, 402*e*, 402*f*, 402*g*, 402*h* may be moved along their longitudinal axes 403 for tuning purposes (i.e., to adjust the bandwidth of the filter). The resonators 402*a*, 402*b*, 402*c*, 402*d*, 402*e*, 402*f*, 402*g*, 402*h* are positioned to permit electromagnetic field coupling between adjacent resonators, i.e., resonators having longitudinal axes that are closest in a linear direction substantially perpendicular to their longitudinal axes (e.g., resonator pairs 402*a* and 402*b*, resonator pairs 402*b* and 402*c*, etc.). Cross coupling between non-adjacent resonators is not desired in this particular circuit design, i.e., resonators having longitudinal axes that are on opposite sides of the longitudinal axis of another resonator in a linear direction substantially perpendicular to their longitudinal axes (e.g., resonators 402*a*, 402*c*). In at least one preferred embodiment, the resonators have a dielectric constant of at least 45 and are formed of barium tetratitanate.

Preferably, each resonator 402*a*, 402*b*, 402*c*, 402*d*, 402*e*, 402*f*, 402*g*, 402*h* is longitudinally inverted relative to its adjacent resonator or resonators. Thus, resonator 402*a* is right side up, resonator 402*b* is upside down, resonator 402*c* is right side up, etc. This arrangement permits the resonators to be placed in closer proximity to one another than in the prior art, thus smaller enclosures 401 are obtainable.

In order to prevent cross coupling between non-adjacent resonators, the housing includes separating walls 430 intermediate non-adjacent resonators in direction 405. Each separating wall 430*b*, 430*c*, 430*e*, 430*f*, 430*g* is parallel to and in the same plane as the longitudinal axis of one of the resonators 402*a*, 402*b*, 402*c*, 402*d*, 402*e*, 402*f*, 402*g*, 402*h* and is substantially perpendicular to direction 405 such that each resonator 402*b*-402*g* has an associated separating wall 430*b*-430*g* that essentially is intended to block coupling between the two resonators on either side of that wall. Thus, for example, separating wall 430*b* helps prevent cross coupling between non-adjacent resonators 402*a* and 402*c* while substantially permitting coupling between the associated resonator 402*b* and its adjacent resonators 402*a* and 402*c*. Likewise, separating wall 430*c* helps prevent cross coupling between non-adjacent resonators 402*b* and 402*d*, while substantially permitting coupling between adjacent resonators 402*b* and 402*c* as well as 402*c* and 402*d*. The first and last resonator 402*a* and 402*h* do not have associated separating walls for obvious reasons. However, including separating walls associated with the first and last resonators would have little or no impact on circuit performance. Such separating walls may be included due to practical fabrication reasons. Particularly, the housing is designed to be extremely flexible so as to permit the construction of many different filters with different numbers of resonators and different sized resonators with different resonator spacings while using a single generic housing design. For instance, if fewer or more resonators than shown in these figures are desired, if separating walls are provided associated with all of the resonator mounting positions, including the first and last, then the housing can simply be shortened or lengthened without changing any other design specification of the housing to accommodate any number of resonators.

A tuning plate 440 is positioned opposite the bottom surface 406*a* of each resonator 402*a*, 402*b*, 402*c*, 402*d*, 402*e*, 402*f*, 402*g*, 402*h* in a through hole 444 in the side wall 401*b* of the housing 401. Alternately, the tuning plate may be placed adjacent the top surface 406*b* of the resonator. The tuning plate can be used to tune the center frequency of each resonator as described above in connection with FIG. 2. The tuning plate may be externally threaded and positioned within a matingly threaded through hole 444 in the housing so as to permit it to be moved longitudinally closer or farther from the associated resonator in order to effect tuning.

Each resonator 402*a*, 402*b*, 402*c*, 402*d*, 402*e*, 402*f*, 402*g*, 402*h* is coupled to the enclosure 401 via a mounting member, such as mounting post 414. The mounting post 414 is parallel to the longitudinal axis of the resonator 402*a*, 402*b*, 402*c*, 402*d*, 402*e*, 402*f*, 402*g*, 402*h* it mounts and, preferably, is coaxial thereto. The mounting post 414 in the illustrated embodiment is adjustable to position the resonator 402*a*, 402*b*, 402*c*, 402*d*, 402*e*, 402*f*, 402*g*, 402*h* for tuning and, preferably, is non-conductive to prevent interference with the coupling between the adjacent and alternate resonators.

In the illustrated embodiment, the displacement of the resonators 402*a*, 402*b*, 402*c*, 402*d*, 402*e*, 402*f*, 402*g*, 402*h* relative to each other is fixed in the transverse direction upon assembly, but is adjustable in the longitudinal direction after assembly. Particularly, in one embodiment, the mounting posts 414 are screwed into threaded holes, such as threaded hole 416 in the side wall; 401*b* of the enclosure 401. The resonators 402*a*, 402*b*, 402*c*, 402*d*, 402*e*, 402*f*, 402*g*, 402*h* also may be adjustably mounted on the mounting posts 414. Particularly, the through holes 404 in the resonators 402*a*, 402*b*, 402*c*, 402*d*, 402*e*, 402*f*, 402*g*, 402*h* may also be threaded to mate with the threads of the mounting posts 414. Accordingly, by rotating the mounting cylinder relative to the holes in the enclosure 401 and/or the through holes in the resonators 402*a*, 402*b*, 402*c*, 402*d*, 402*e*, 402*f*, 402*g*, 402*h*, the longitudinal positions of the resonators relative to each other and to the enclosure 401 can be adjusted easily.

The mounting posts 414 pass through the separating walls 430*b*, 430*c*, 430*e*, 430*f*, 430*g* associated with the corresponding resonator.

In a preferred embodiment, the holes 416 in the enclosure are through holes, i.e., they pass completely through the separating walls, and the mounting posts 414 are long enough to pass completely through the length of the separating walls 430 and to the outside of the enclosure 401. This enables the resonator spacing, and thus the bandwidth of the filter, to be adjusted by rotating the mounting cylinders that protrude from the enclosure without even opening the enclosure 401.

The design shown in FIGS. 4A and 4B is extremely flexible and permits the construction of a wide variety of filters having different center frequencies and bandwidths with a single basic design. Some of the features of this design that enable such flexibility are the threaded adjustable mounting posts, the separating walls between the non-adjacent resonators, the longitudinally adjustable tuning plates, and the fact that the resonators are positioned in a single row.

Aforementioned U.S. Pat. No. 7,057,480 issued Jun. 6, 2006 discloses a very similar looking circuit, but in which cross-coupling between non-adjacent resonators, is encouraged. In U.S. Pat. No. 7,057,480, cross-coupling is induced by designing the mounting posts as hollow cylinders having internal threads and placing a conductive cylinder having external threads for mating with the internal threads of the hollow mounting post inside of the hollow resonator mounting post. By turning the conductive cylinder within the hollow mounting cylinder, the position of the conductive cylinder is altered such that more or less of the conductive cylinder is inserted between the resonators on either side of the conductive cylinder, thereby affecting the cross-coupling between the alternate resonators separated by the conductive cylinder. Since the conductive member is isolated from the enclosure (which is grounded) by the non-conductive mounting member, generated charges in the conductive member do not flow to ground. Instead, the charges are stored in the conductive member to produce capacitive cross-coupling between the non-adjacent resonators.

The circuit of FIGS. 4A and 4B of the present application is a more conventional circuit in which there is to be no cross-coupling between non-adjacent resonators. Accordingly, as noted above, the mounting posts 414 are non-conductive and do not contain any conductive inserts or cores. Accordingly, cross-coupling between non-adjacent resonators is not encouraged.

Nevertheless, because, in this single row design, there is a relatively direct path for electromagnetic coupling between two non-adjacent resonators through the irises or other openings that permit the adjacent resonators to couple with each other, as illustrated by arrow 439 (FIG. 4A), non-negligible cross-coupling between non-adjacent resonators can occur. This would adversely affect the desired operation of the circuit.

Generally, undesired cross-coupling between non-adjacent resonators is not appreciable when the dielectric resonators of the circuit have a relatively high dielectric constant, approximately 45 or greater. Also, if the horizontal spacing between the resonators is large enough, cross-coupling between non-adjacent resonators also is not appreciable.

However, many circuit designs call for, or at least utilize, dielectric resonators with dielectric constants lower than about 45. For instance, providing very high quality factor, Q, is often a key concern in dielectric resonator circuit design. Generally, higher Q can be provided by using lower dielectric constant materials for the dielectric resonators. Furthermore, generally, lower dielectric constant materials are used in circuits with lower center frequencies.

The lower the dielectric constant of the resonator material, the less concentrated the electric field is within the resonator. The concentration of the magnetic fields (i.e., the fields that actually couple between separate resonators) are proportional to their corresponding electrical field. Accordingly, the lower the dielectric constant of the resonator material, the more spread out the magnetic field. Hence, the lower the dielectric constant of the resonator material, the closer the horizontal spacing between the resonators that will be necessary to achieve a given circuit's objectives. Accordingly, in circuits utilizing dielectric resonators with dielectric constants of less than about 45, undesired cross coupling between non-adjacent resonators can be problematic.

Cross-coupling between non-adjacent resonators can be reduced or even eliminated by making the separating walls longer (and, consequently, the irises smaller). However, making the separating walls longer has several adverse effects. Most notably, it will decrease the Q of the circuit because it will place more metal closer to the resonators. Furthermore, although less of an concern than the effect on the Q of the circuit, it also will decrease coupling between the adjacent resonators.

Figure 5:
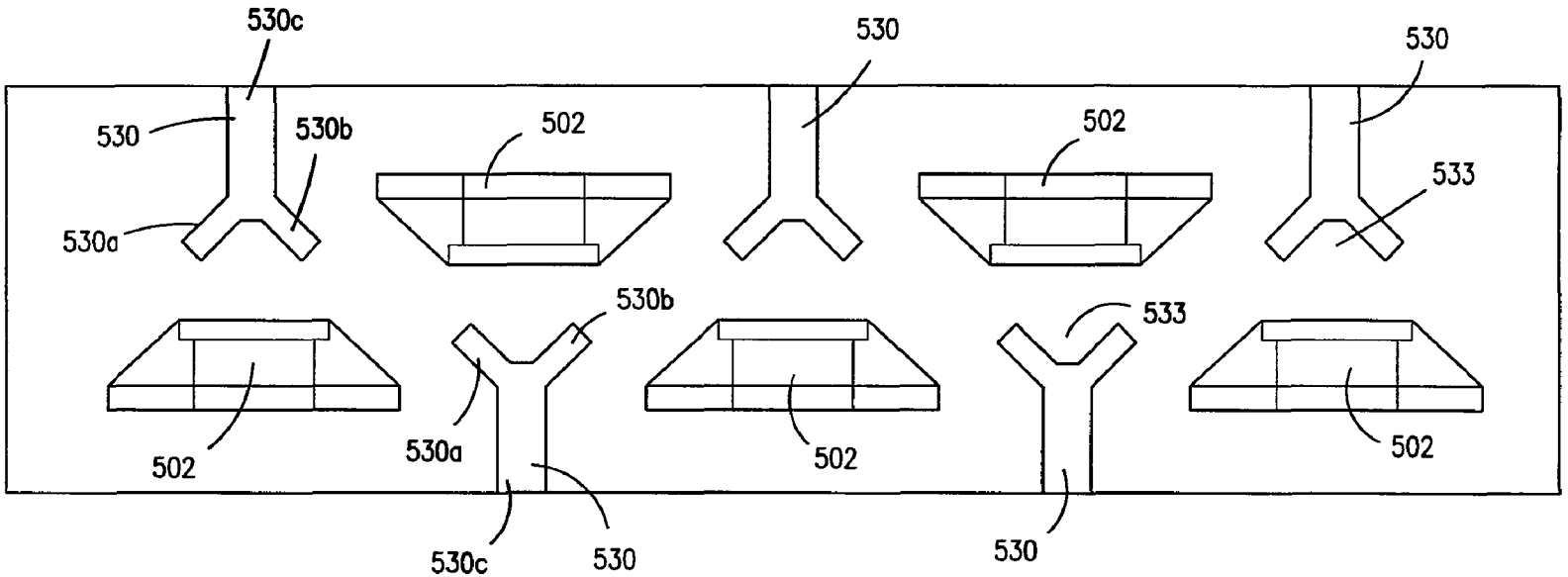
FIG. 5 is a top view of a dielectric resonator circuit comprising a plurality of resonators arranged in a single row and incorporating the principles of the present invention.

FIG. 5 is a plan view of a dielectric resonator circuit similar to the circuit shown in FIGS. 4A and 4B, but incorporating technology in accordance with an embodiment of the present invention that reduces or entirely eliminates cross-coupling between the nonadjacent resonators. In order not to obfuscate the invention, FIG. 5 shows only the housing, including the separating walls, and the resonators 502. All other structure, such as mounting posts and input and output couplers, are not shown for sake of clarity. The separating walls 430*b*, 430*c*, 430*e*, 430*f*, 430*g* of FIGS. 4A and 4B have been replaced with separating walls 530 that terminate (at the end of the wall adjacent the iris), with an extension wall portion that extends at least in part at an angle (other than 0 degrees) from the main wall portion. Preferably, the extension wall portion comprises two halves that are mirror images of each other, the plane of reflection being the plane of the main wall portion. Also preferably, each half of the extension comprises a surface that extends in a direction parallel to the side wall of the resonator that it is intended to prevent cross coupling from. In the particular embodiment illustrated in FIG. 5, the separating walls 530 include two mirror image legs, 530*a* and 530*b*, each extending at an angle to each other and at an angle to the main wall portion 530*c*. Overall, the separating wall 530 in this particular embodiment is Y-shaped. In a preferred embodiment of the invention, the two legs 530*a* and 530*b* extend at angles from the main wall portion 530*c* such that their sides are parallel to the sides of the resonators 502 that are to the corresponding side of the wall 530.

Particularly, this is an advantageous angle for at least two reasons. First, this helps maximize the portion of the magnetic field that might otherwise extend all the way to the next non-adjacent resonator that instead intersects the separating wall 530 (and, therefore, essentially is lost and, hence, cannot cross couple with another resonator). Second, the inside planar surfaces 532 of the legs 530*a*, 530*b* define a space 533 generally between leg 530*a*, leg 530*b*, and the top surface of the associated resonator. This open space is advantageous because metal near the top of the resonator body would substantially reduce the Q of the circuit.

Figure 6A:
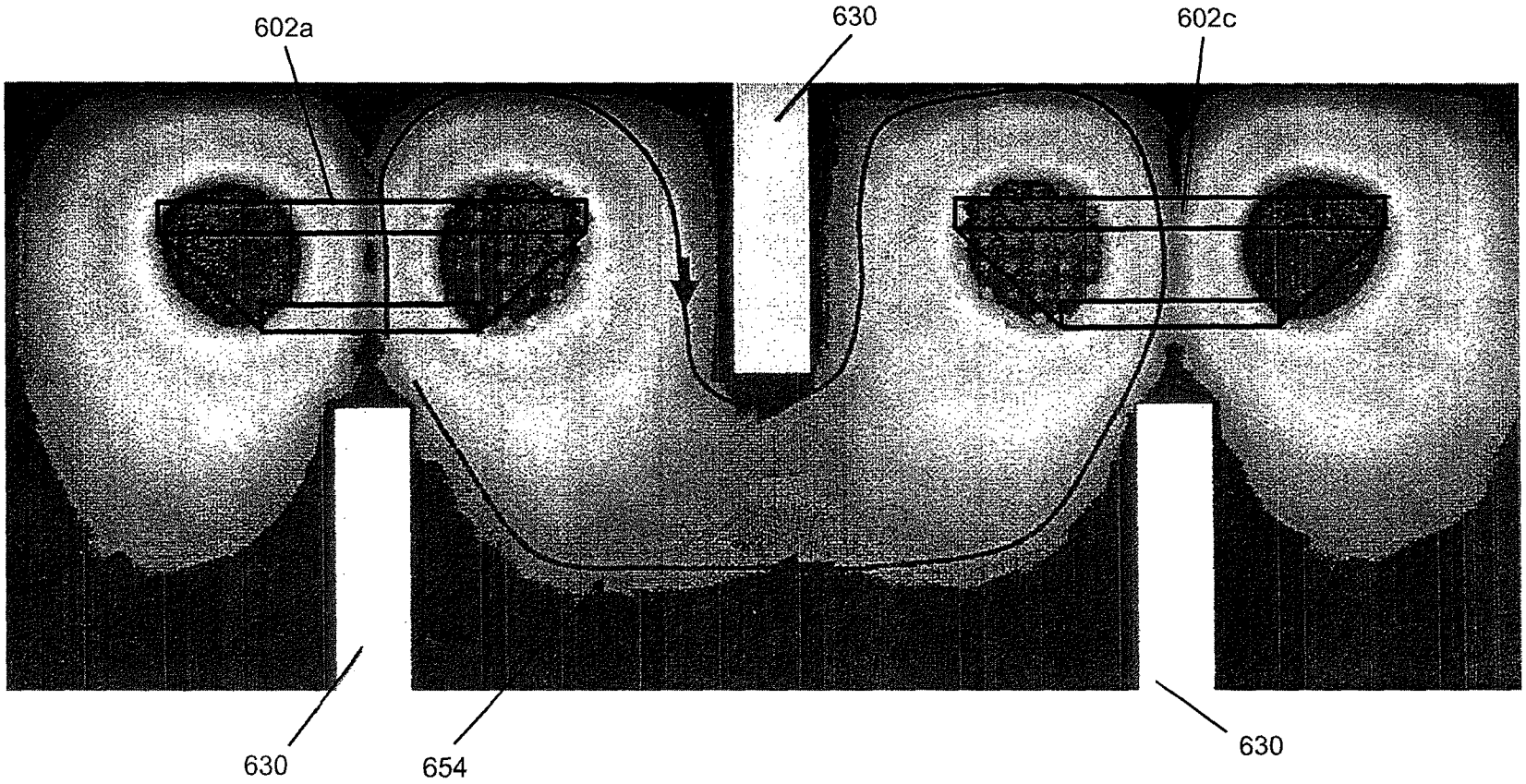
FIG. 6A is a drawing illustrating the interaction of magnetic fields of the two non adjacent resonators in a dielectric resonator circuit of the prior art.
Figure 6B:
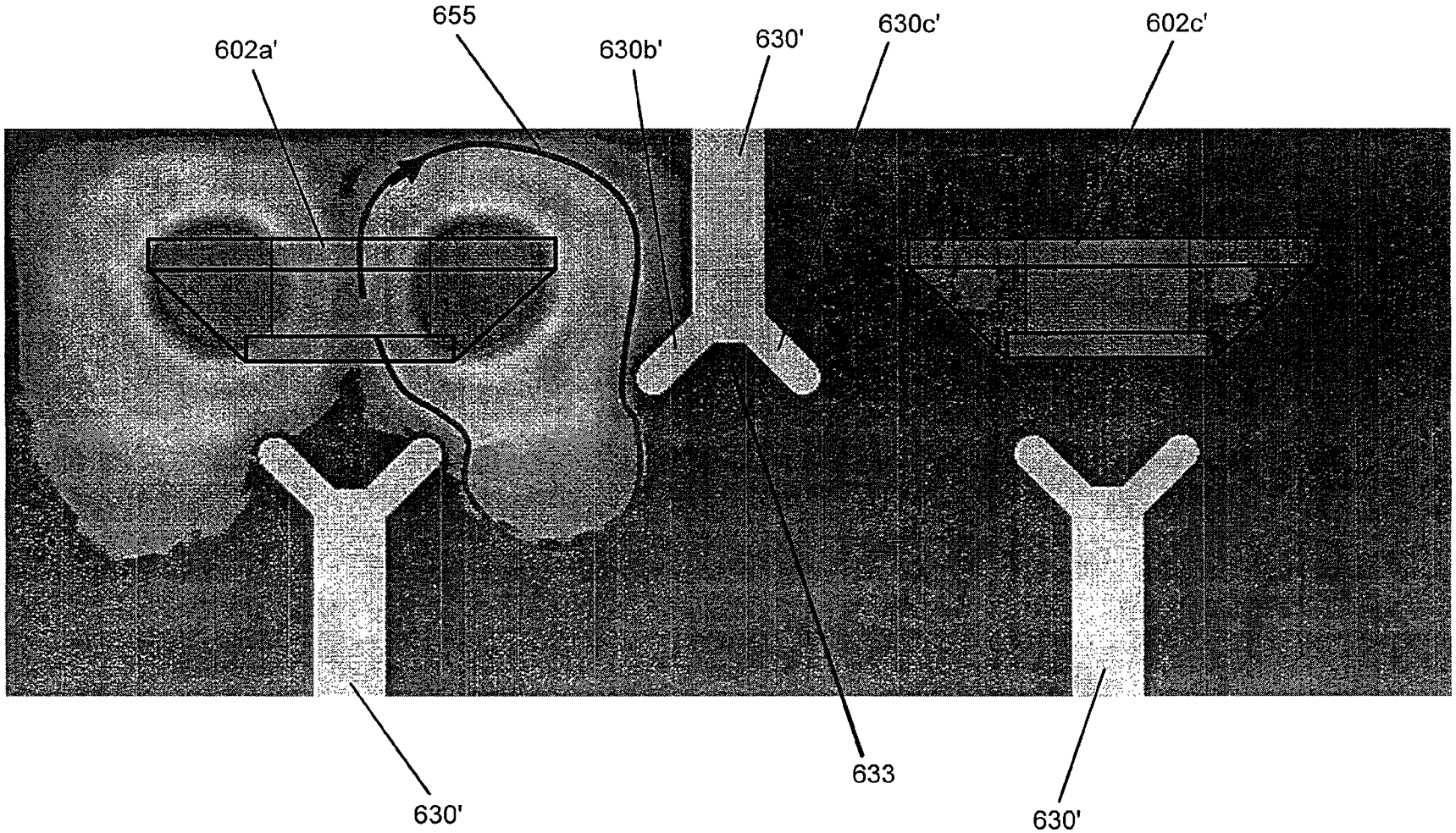
FIG. 6B is a drawing illustrating the interaction of magnetic fields of the two non adjacent resonators in a dielectric resonator circuit in accordance with the present invention.

FIGS. 6A and 6B helps illustrate the effectiveness of the present invention. FIG. 6A illustrates the magnetic field coupling between two nonadjacent resonators 602*a* and 602*c* in a dielectric resonator circuit utilizing a housing having conventional straight separating walls 630 like those illustrated in FIGS. 4A and 4B. The middle resonator has been removed so as not to obfuscate the illustration. The first resonator has been excited with a field at a center frequency of 2.5135 GHz. FIG. 6A shows that there is coupling of this field to the non-adjacent resonator 602*c* around the separating walls 630. The path is illustrated generally by path 654. Simulations demonstrate that coupling is about 0.6 MHz.

FIG. 6B illustrates the magnetic field coupling between two nonadjacent resonators 602*a*' and 602*c*' in a dielectric resonator circuit utilizing a housing having Y shaped separating walls 630' like those illustrated in the embodiment of the invention shown in FIG. 5. As can be seen, the Y-shaped wall 630' in the middle, and particularly the extending legs 630*b*', 630*c*' that are parallel to the side surfaces of the resonator 602*a*', 602*c*', respectively, substantially intersect that portion of the magnetic field lines of resonator 602*a*' that might otherwise couple to non-adjacent resonator 602*c*'. On the other hand, wall 630' substantially does not block the portion of the magnetic field lines that pass through and, therefore, would couple with the adjacent resonator (not shown). Path 655 illustrates the changes to the field lines relative to the FIG. 6A simulation. There is essentially no coupling between the non-adjacent resonators 602*a*' and 602*c* '.

Further, note that the area between the legs 630*b*', 630*c*' define an open space 633 near the top of the intermediate resonator (which is not shown in FIG. 6B so as not to obfuscate the illustration) so as not to substantially reduce the Q of the resonator 602*b* or the overall circuit (because there is no metal near the resonator).

Figure 7:
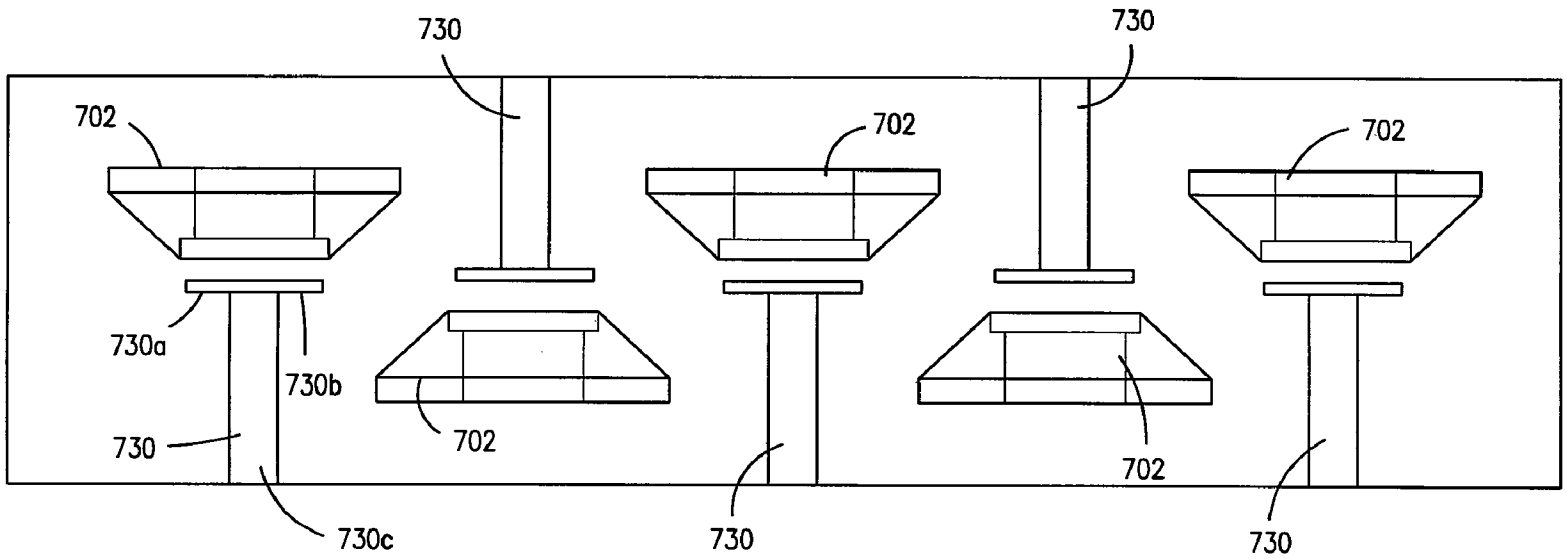
FIG. 7 is a top plan view of a dielectric resonator circuit in accordance with an alternate embodiment of the present invention.
Figure 8:
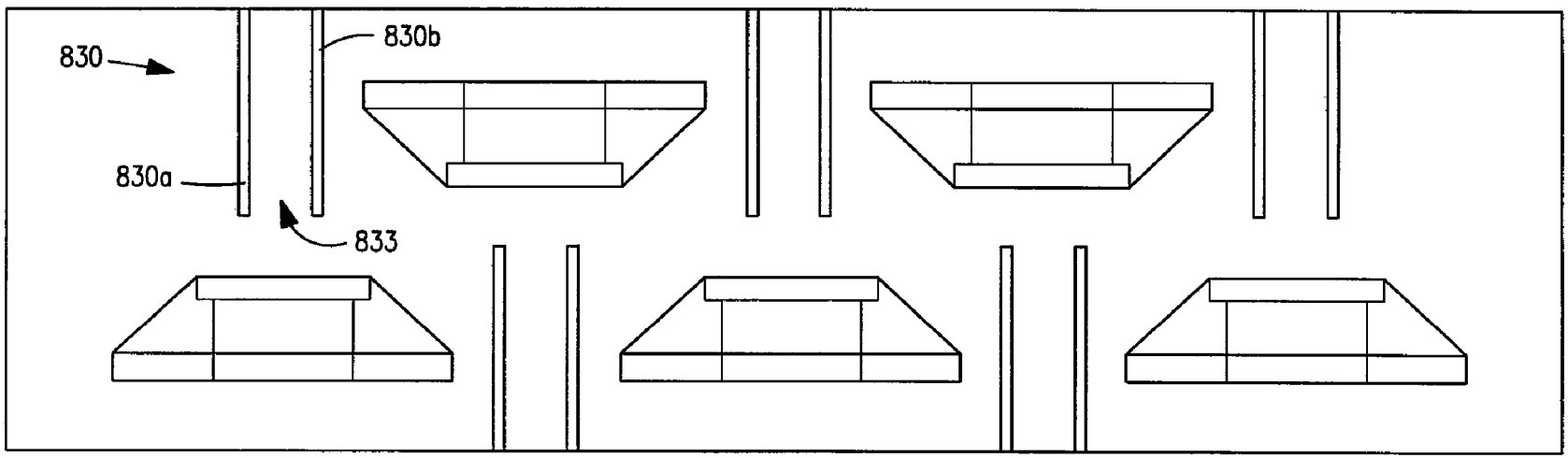
FIG. 8 is a top plan view of a dielectric resonator circuit in accordance with a third embodiment of the present invention.

The Y-shaped wall configuration, while particularly advantageous, especially in connection with conical resonators, is merely exemplary. Other wall configurations are possible. Particularly, FIG. 7 is a plan view of a dielectric resonator circuit illustrating an alternative embodiment of the invention in which the separating walls 730 are T-shaped, comprising main wall portion 730*c* and perpendicular extensions 730*a*, 730*b*. A T-shaped separating wall is particularly suitable for use in dielectric resonator circuits employing cylindrical resonators. Again, this particular T-shaped configuration will be especially effective in blocking the portion of the magnetic field lines of the resonators 702 that would otherwise couple to non-adjacent resonators, while substantially not blocking the portion of the magnetic field that couples to the adjacent resonators. FIG. 8 illustrates yet another embodiment of the invention. In this embodiment, the separating walls 830 includes two parallel straight portions 830*a*, 830*b* defining a space 833 there between. The two wall portions 830*a*, 830*b* are substantially parallel to the longitudinal axis of the associated resonator and on opposing sides thereof. The longitudinal axis of the associated resonator runs down the middle of the gap.

Note that this embodiment provides open space 833 above the longitudinal end of the middle resonator along and surrounding the longitudinal axis of that resonator, while simultaneously providing conducting surfaces near the resonators on either side of the middle resonator. Furthermore, in the case of cylindrical resonators, these wall portions 830*a*, 830*b* are parallel to the side walls of those side resonators. This particular separating wall shape, however, is also highly effective in connection with conical resonators.

Figure 9:
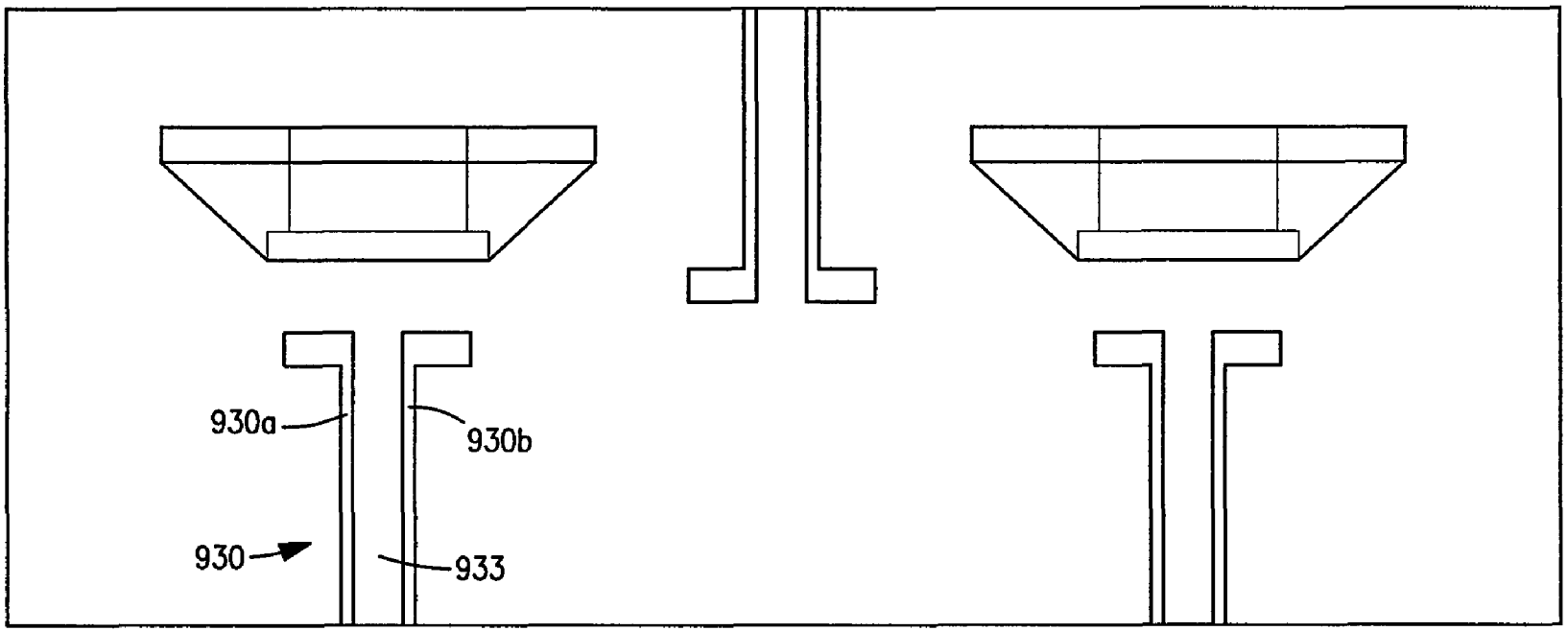
FIG. 9 is a top plan view of a dielectric resonator circuit in accordance with a fourth embodiment of the present invention.

FIG. 9 illustrates an even further embodiment of the invention in which each separating wall 930 comprises two L-shaped portions 930*a*, 930*b* defining a space 933 there between. This is quite similar to the T-shaped embodiment of FIG. 7, except in addition, it provides additional open space along and adjacent the longitudinal axis of the middle resonator.

Figure 10:
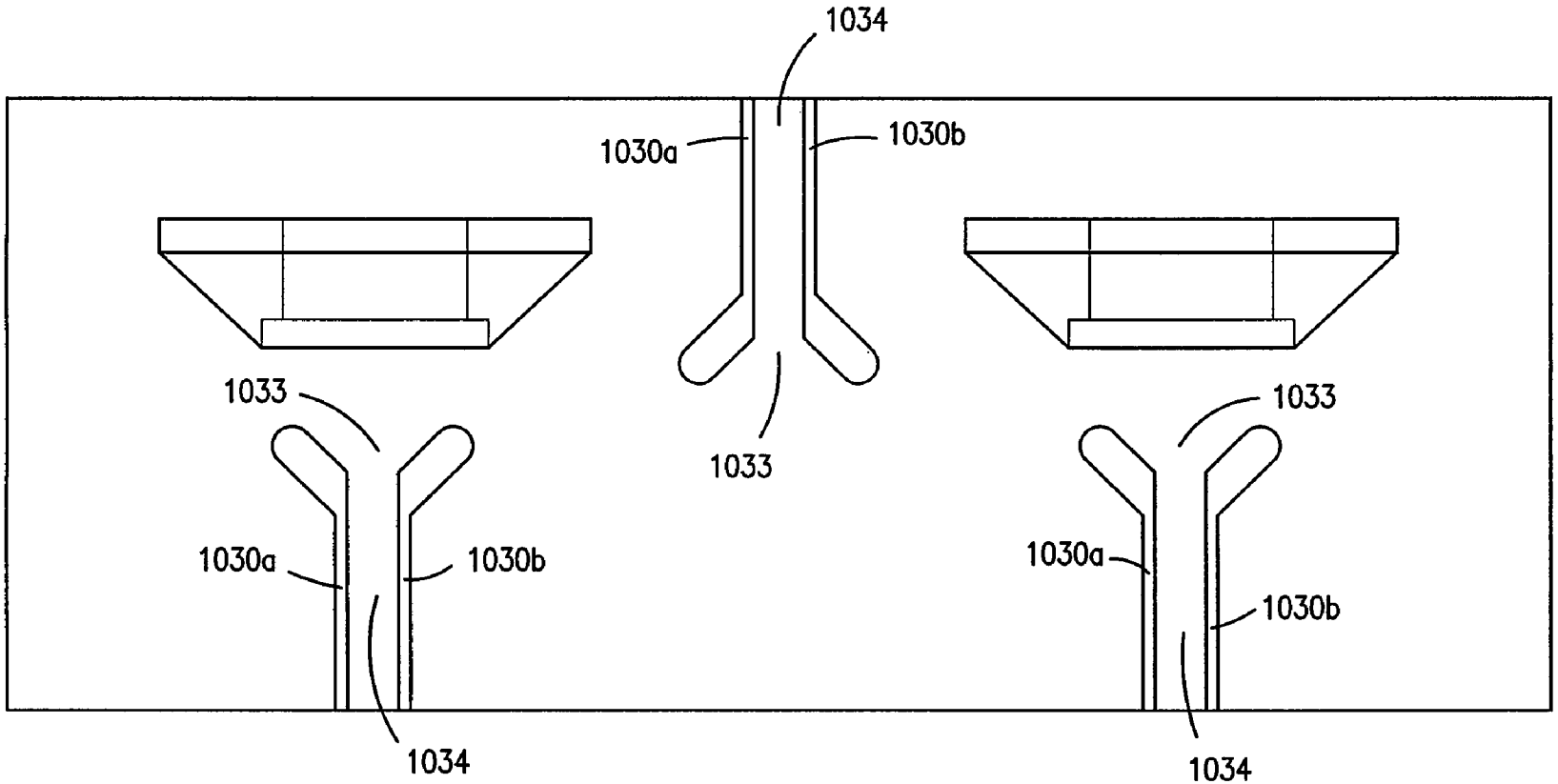
FIG. 10 is a top plan view of a dielectric resonator circuit in accordance with a fifth alternate embodiment of the present invention.

FIG. 10 shows another embodiment similar to the Y-shaped wall embodiment of FIG. 5, except, like the embodiment of FIG. 9, the separating wall 1030 comprises two mirror image, half Y portions 1030*a* and 1030*b* providing open space 1033 there between. This is similar to the embodiment of FIG. 5 comprising Y-shaped walls 530, except that it provides even more open space along the longitudinal axis of the middle resonator. Specifically, in addition to providing triangular open space 1033 similar to the triangular open space 533 in the FIG. 5 embodiment, it also provides additional open space 1034 along and adjacent the longitudinal axis of the middle resonator further away from the end of the resonator. Like the embodiment of FIG. 5, this embodiment is particularly effective in circuits having conical resonators and particularly, if the extensions are parallel to the side walls of the resonators.

Figure 11:
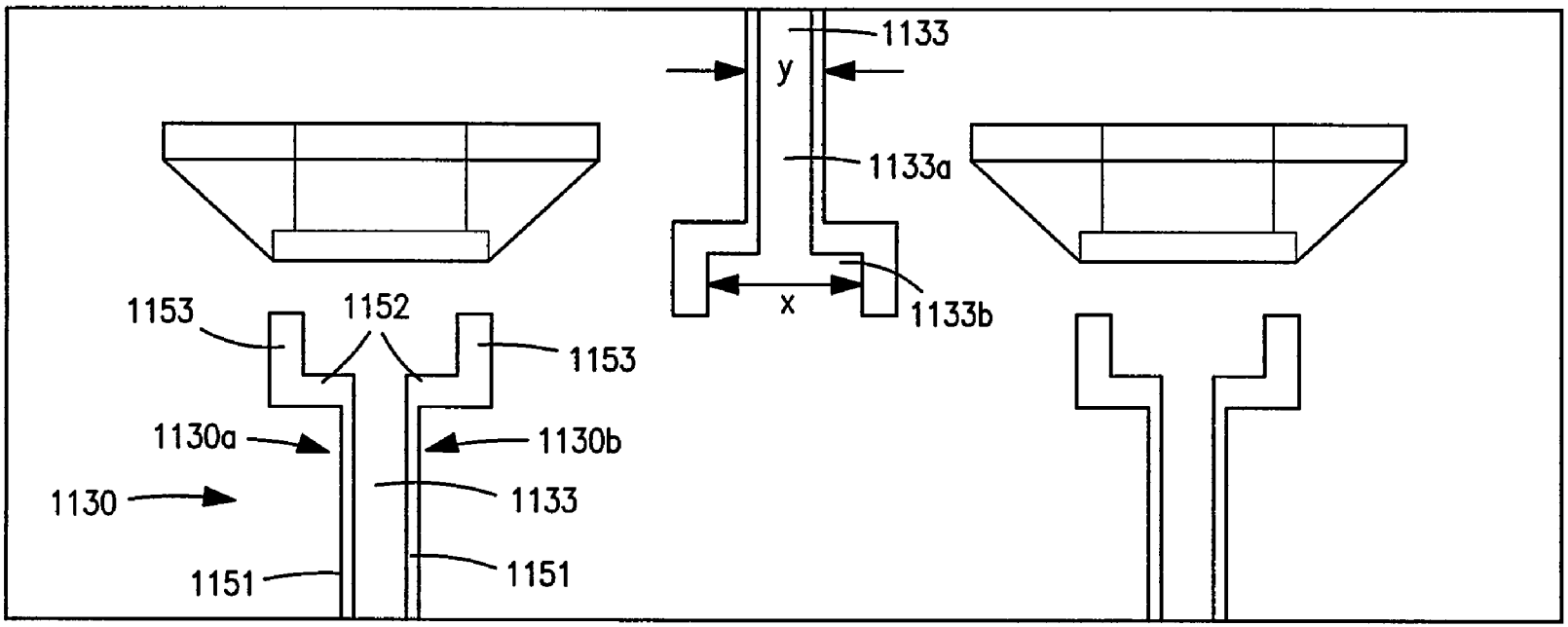
FIG. 11 is a top plan view of a dielectric resonator circuit in accordance with a sixth alternate embodiment of the present invention.

FIG. 11 illustrates yet a further embodiment of the invention in which each separating wall 1130 generally has a shape similar to that of an American football goalpost. In the particular embodiment illustrated by FIG. 11, it comprising two wall portions 1130*a*, 1130*b*, each comprising three segments 1151, 1152, 1153, as shown. This embodiment is suitable for use in connection with both cylindrical resonators and conical resonators. Note that it provides substantial open space 1133 along and adjacent the longitudinal axis of the middle resonator. Specifically, immediately adjacent the longitudinal end of the middle resonator, the portion of the open space 1133*a* between the two walls has a width of x, whereas, further away from the resonator, the portion of the open space 1133*b* has a smaller width y. In an alternative embodiment, the separating wall 1130 may be a single wall, e.g., main walls 1151 of wall portions 1130*a* and 1130*b* may be a single wall (thus eliminating the portion of space 1130 having width y, but leaving the portion of space 1133 having width x.

Figure 12:
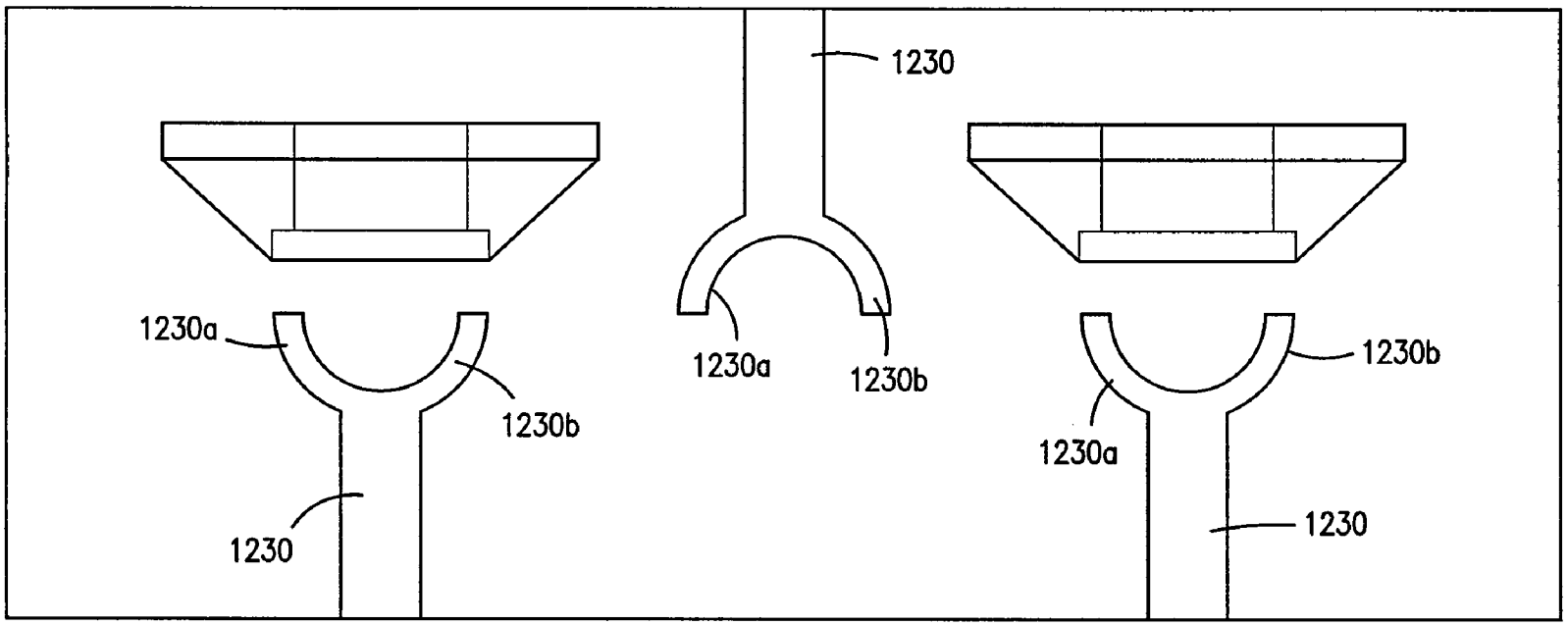
FIG. 12 is a top plan view of a dielectric resonator circuit in accordance with a seventh alternate embodiment of the present invention.
Figure 13:
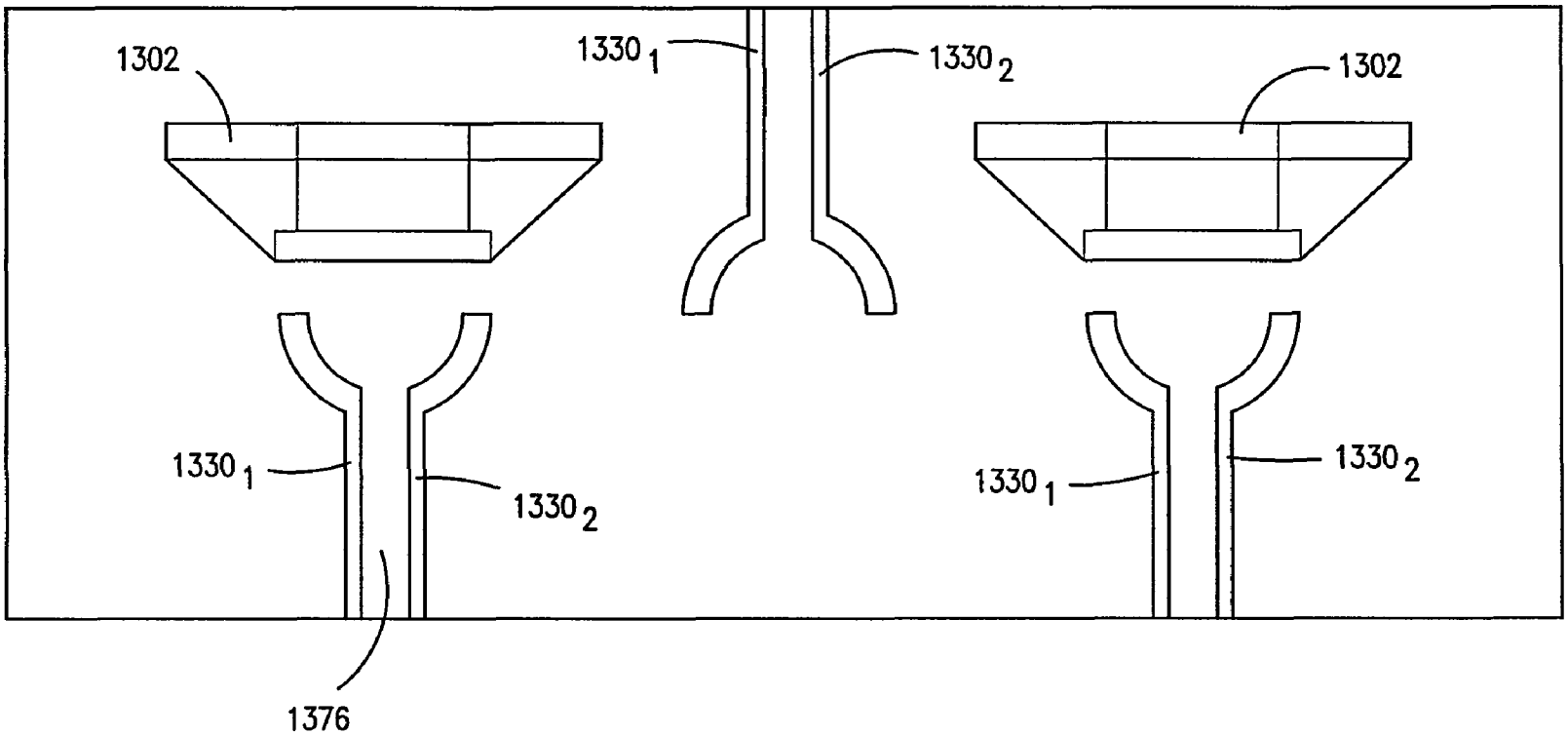
FIG. 13 is a top plan view of a dielectric resonator circuit in accordance with an eighth alternate embodiment of the present invention.

Another alternative shape is a separating wall 1230 that terminates in a U-shaped projection comprised of extension halves 1230*a*, 1230*b*, as shown in FIG. 12. This is similar to the embodiment of FIG. 5, except that the extensions comprises curved walls 1230*a*, 1230*b*, rather than straight walls 530*a*, 530*b*. Alternatively, as illustrated in FIG. 13, a separating wall with U shaped extensions very similar to that illustrated in FIG. 12 can be split into two separate walls $\mathbf{1330}_1$, $\mathbf{1330}_2$ providing a long space 1376 there between aligned with the longitudinal axis of the associated resonator 1302.

Although a filter is depicted and described in the various embodiments mentioned above, the present invention is applicable to other types of dielectric resonator circuits, including by way of example, but not limited to, oscillators, triplexers, antennas, etc.

Having thus described a few particular embodiments of the invention, various alterations, modifications, and improvements will readily occur to those skilled in the art. For example, the mounting members may mount the resonators in a fixed position with tuning being fixed upon assembly or adjusted through the use of tuning plates and/or conductive members. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

The invention claimed is:

1. A dielectric resonator circuit comprising:

a housing;

first, second, and third resonators positioned substantially in a row in a first direction within said housing with said second resonator positioned between said first and third resonators;

said housing enclosing said first, second, and third resonators and further comprising a separating wall intermediate said first and third resonators in said first direction in order to inhibit coupling between said first and third resonators; and wherein said separating wall comprises a first end and a second end along a length thereof and wherein said wall defines an iris at said first end, said iris positioned to permit coupling between said first resonator and said second resonator and between said second resonator and said third resonator, said wall comprising a main wall portion positioned substantially between said first and third resonators and an extension wall portion at said first end that extends at a non-zero angle from said main wall portion of said separating wall.

2. The dielectric resonator circuit of claim 1 wherein said dielectric resonators each have longitudinal axes and said longitudinal axes are substantially parallel, substantially coplanar, and not collinear with each other, and wherein said longitudinal axis of said second resonator is substantially in a same plane as said main wall portion of said separating wall.

3. The dielectric resonator circuit of claim 2 wherein said separating wall is substantially perpendicular to said first direction.

4. The dielectric resonator circuit of claim 1 wherein said main wall portion comprises two halves parallel to each other and defining a space there between.

5. The dielectric resonator circuit of claim 1 wherein said main wall portion of said separating wall defines a plane and said extension wall portion of said separating wall comprises first and second halves that are mirror images of each other about said plane of said main wall portion of said separating wall.

6. The dielectric resonator circuit of claim 5 wherein said extension wall portion of said separating wall comprises first and second legs extending from said first end of said main wall portion.

7. The dielectric resonator circuit of claim 6 wherein said separating wall is Y-shaped.

8. The dielectric resonator circuit of claim 6 wherein said dielectric resonators are conical.

9. The circuit of claim 8 wherein said separating wall is Y-shaped.

10. The dielectric resonator circuit of claim 9 wherein each said dielectric resonator is conical and comprises a side surface and wherein said main wall portion of said separating wall extends substantially coplanar with said longitudinal axis of said second resonator and said first and second legs of said separating wall extend substantially parallel to said side surface of said first resonator and said third resonator, respectively.

11. The circuit of claim 10 wherein said second resonator is inverted relative to said first and third resonators.

12. The dielectric resonator circuit of claim 8 wherein said separating wall is T-shaped.

13. The dielectric resonator circuit of claim 6 wherein said separating wall is T-shaped.

14. The dielectric resonator circuit of claim 6 wherein said separating wall is goalpost shaped.

15. The dielectric resonator circuit of claim 6 wherein said dielectric resonators are conical and have longitudinal axes and side walls disposed radially about said longitudinal axes and wherein said longitudinal axes are substantially parallel to each other and wherein said longitudinal axis of said second resonator extends substantially in a same plane as said main wall portion of said separating wall and first leg of said separating wall extends substantially parallel to said side wall of said first resonator and said second leg of said separating wall extends substantially parallel to said side wall of said third resonator.

16. The dielectric resonator circuit of claim 6 wherein said first and second legs are each L-shaped.

17. The dielectric resonator circuit of claim 16 wherein said main wall portion comprises first and second side-by-side walls defining a space there between and wherein said first and second legs extend from said first and second side-by-side walls of said main wall portion, respectively.

18. The dielectric resonator circuit of claim 6 wherein said first and second legs are curved so that said extension wall portion of said separating wall is U-shaped.

19. The dielectric resonator circuit of claim 18 wherein said main wall portion comprises two halves parallel to each other and defining a space there between.

20. The dielectric resonator circuit of claim 1 wherein said dielectric resonators have longitudinal axes and side walls disposed radially about said longitudinal axes and wherein said longitudinal axis of said second resonator extends substantially in a same plane as said main wall portion of said separating wall and wherein said extension wall portion of said separating wall comprises first and second legs extending from said first end of said main wall portion and said first and second legs define an open space there between through which said longitudinal axis of said second resonator passes.

21. The dielectric resonator circuit of claim 20 wherein said dielectric resonators are conical and said second resonator is inverted relative to said first and third resonators.

22. The dielectric resonator circuit of claim 21 further comprising a mounting member for mounting said second resonator to said housing, said mounting member having a longitudinal axis collinear with said longitudinal axis of said second resonator and said mounting member for said second resonator passing at least partially through said main wall portion of said separating wall.

23. The dielectric resonator circuit of claim 22 wherein said mounting member is adapted to permit adjustment of said second resonator along said longitudinal axis of said second resonator.

24. The dielectric resonator circuit of claim 23 wherein said mounting member comprises a mounting screw coupled to said second resonator and to a coupling on said housing, wherein said coupling is a threaded coupling so that said second resonator can be adjustably positioned along said longitudinal axis of said second resonator relative to said housing.

25. The dielectric resonator circuit of claim 20 wherein said dielectric resonators are conical and said second conical resonator has a first basal surface and a second basal surface opposite said first basal surface, said first basal surface having a smaller area than said second basal surface and wherein said first basal surface is positioned adjacent said separating wall.

26. The dielectric resonator circuit of claim 1 wherein said dielectric resonators have longitudinal axes and side walls disposed radially about said longitudinal axes and wherein said longitudinal axis of said second resonator extends substantially in a same plane as said main wall portion of said separating wall and wherein said main wall portion comprises first and second side-by-side walls defining a space there between.

27. The dielectric resonator circuit of claim 1 wherein said separating wall is T-shaped.

28. The dielectric resonator circuit of claim 27 wherein said main wall portion comprises first and second side-by-side walls defining a space there between and wherein said extension wall portion comprises first and second legs extending from said first and second side-by-side walls of said main wall portion, respectively.

29. The dielectric resonator circuit of claim 1 wherein said dielectric resonators have longitudinal axes and side walls disposed radially about said longitudinal axes and wherein said longitudinal axis of said second resonator extends substantially in a same plane as said main wall portion of said separating wall and wherein said main wall portion comprises first and second side-by-side walls defining a space there between.

30. A dielectric resonator circuit comprising:

a housing first, second, and third resonators positioned substantially in a row in a first direction within said housing with said second resonator positioned between said first and third resonators;

said housing enclosing said first, second, and third resonators and further comprising a separating wall positioned between said first and third resonators in order to inhibit electromagnetic coupling between said first and third resonators, wherein said separating wall comprises two side-by-side walls defining a gap there between.

31. The dielectric resonator circuit of claim 30 wherein each said dielectric resonator has a longitudinal axis and said longitudinal axes are substantially parallel, substantially coplanar, and not collinear with each other, and wherein said two side-by-side walls are each substantially parallel to said longitudinal axis of said second resonator and on opposing sides of said longitudinal axis of said second resonator in said first direction.

32. The dielectric resonator circuit of claim 31 wherein said two side-by-side walls are substantially perpendicular to said first direction.

* * * * *